United States Patent [19]

Staudt et al.

[11] 3,981,634

[45] Sept. 21, 1976

[54] FUEL INJECTION PUMP FOR INTERNAL COMBUSTION ENGINES

[75] Inventors: Heinrich Staudt, Markgroningen-Talhausen; Eberhard Hofmann, Kirchbert, M., both of Germany

[73] Assignee: Robert Bosch G.m.b.H., Stuttgart, Germany

[22] Filed: Mar. 27, 1975

[21] Appl. No.: 562,858

[30] Foreign Application Priority Data

Apr. 1, 1974 Germany ..... 2415719

[52] U.S. Cl. ..... 417/499

[51] Int. Cl.[2] ..... F04B 39/10; F04B 7/04

[58] Field of Search ..... 417/494, 499, 360, 289; 123/139 AA

[56] References Cited

UNITED STATES PATENTS 3,885,895 5/1975 Staudt et al. ..... 417/499

FOREIGN PATENTS OR APPLICATIONS 565,383 11/1944 United Kingdom ..... 417/494

*Primary Examiner*—William L. Freeh

*Attorney, Agent, or Firm*—Edwin E. Greigg

[57] ABSTRACT

A fuel injection pump for internal combustion engines including a cylinder bushing and a mounting flange fastened thereto. The mounting flange mounts the cylinder bushing to a pump housing and includes an adjustment tool engaging portion. This adjustment tool engaging portion extends transversely outwardly from the longitudinal axis of the cylinder bushing to a greater extent than does the location of the bolts which mount the flange to the pump housing. The cylinder bushing is received within the pump housing so that it can be rotated by the adjustment tool within a limited angular region for effecting a basic setting of the fuel quantity supplied by the pump.

4 Claims, 2 Drawing Figures

FUEL INJECTION PUMP FOR INTERNAL COMBUSTION ENGINES

BACKGROUND OF THE INVENTION

The present invention relates to a fuel injection pump for internal combustion engines and in particular to a fuel injection pump including means for effecting a basic setting of the pump without affecting its structural length.

The pump under consideration includes a housing having at least one bore, and an associated cylinder bushing or flanged sleeve which is freely inserted into the housing bore for mounting the cylinder bushing to the housing. The sleeves or bushings are rotatable within a limited angular region for the basic setting of a supplied fuel quantity and are provided with a mounting flange which is clamped by bolts to the upper end face of the pump housing. In order to change the supplied fuel quantity, a pump piston is both axially and rotationally movably guided in a bore of the cylinder bushing and is provided with an oblique control edge which cooperates with at least one control bore in the wall of the cylinder bushing. In a continuation of the bore in which the piston is located, there is disposed a pressure valve which has a valve housing and a valve spring. The valve housing and/or the spring are held in their installed position within the flanged housing or the cylinder bushing by a threaded nipple. The nipple in turn serves for the outflow of the fuel which is under the influence of an injection pressure.

In known fuel injection pumps whose cylinder bushings or flanged sleeves for accepting the cylinder bushing are provided with a mounting flange, these so-called flanged elements are rotatable within a limited angular region for the purpose of setting a basic fuel quantity. Usually this is done after releasing two fastening bolts and tapping lightly with a tool on the outer edge of the mounting flange. This kind of adjustment of the flanged elements is both very time-consuming and also very highly dependent on the ability of the person doing the adjusting and, in addition, there is the danger that the flange may be damaged. Furthermore, an adjustment of this type can only be made after the fastening bolts have been released almost completely. Thus, this adjustment cannot be made when the pump is running.

In a known fuel injection system of the above described construction, the cited disadvantages are overcome at least partially by providing set screws on the flange at the level of the elongated holes which are supported by the mounting bolts screwed into the pump housing. When the flange is to be rotated for adjusting the basic fuel quantity setting, then both the mounting bolts as well as the two set screws must be released and one of the set screws must be screwed in while the other one is screwed out. After this adjustment, the set screws must be locked with lock nuts and the mounting bolts must be tightened again. This adjustment process is very time-consuming and the adjustment mechanism located on the mounting flange is very expensive and requires a considerable amount of space. The presence of the set screws increases the mutual separation of the elements in an impermissible manner when multi-cylinder injection pumps are involved and this is very disadvantageous for modern injection systems because a very compact construction is very desirable.

OBJECTS AND SUMMARY OF THE INVENTION

It is therefore an object of the present invention to provide a fuel injection pump of the above described kind which does not have the above described disadvantages and which is improved so that an adjustment can be effected without affecting the structural length of the pump.

It is another object of the present invention to provide a fuel injection pump of the above described kind which permits shortening the time required for the adjustment of the flanged element by making it possible to make the basic fuel quantity adjustment while the pump is running.

These and other objects are attained, according to the present invention, by providing a mounting flange with a location for the engagement of an adjustment tool within the outer circumference of the mounting flange and at a distance from the central axis of the cylinder bushing that is greater than the outer limit of the mounting bolts. In this manner, the required rotation of the mounting flange and hence of the cylinder bushing for the purpose of changing the basic fuel quantity can be done mechanically which is particularly advantageous, for example, by means of an electrically driven adjustment tool and this may be done while the pump is running.

A particularly advantageous embodiment of the present invention results because the part of the mounting flange which includes the region of attack for the adjustment tool extends beyond the upper face of the pump housing. This has the outstanding advantage that the adjustment tool may work from the side of the pump and can be much heavier than the mounting flange itself, permitting it to transmit very high adjustment forces which make possible an adjustment of the mounting flange in its operational condition, i.e., when the pump is running.

A further advantage according to the present invention results in that the location of engagement on the mounting flange is formed by a slot whose sides and base are parallel to the longitudinal axis of the cylinder bushing. Such a slot has been shown to be the most favorable method of engaging the flange because the remaining portions of the mounting flange on both sides of the slot are capable of transmitting the required high setting force. Furthermore, such a slot may be produced in a simple manner, for example, it can be produced at the same time as the elongated bores for the mounting bolts are made. Moreover, such a slot can be produced especially advantageously if the mounting flange is stamped from sheet steel and is soldered or welded to the cylinder bushing.

The invention will be better understood, and further objects and advantages thereof will become more apparent from the ensuing detailed specification of a preferred although exemplary embodiment of the present invention taken in conjunction with the drawing.

DESCRIPTION OF THE PREFERRED EMBODIMENT

Figure 1:
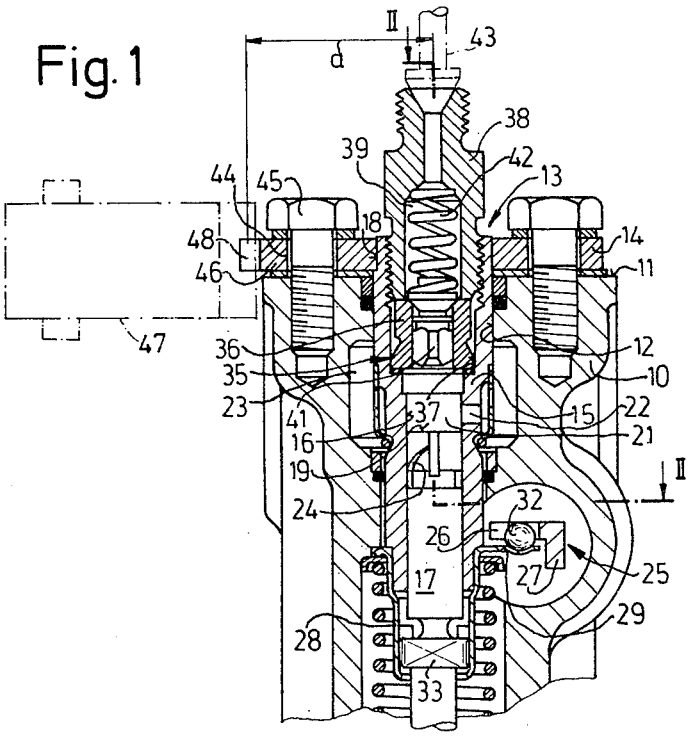
FIG. 1 is a cross-sectional view through the most essential portions of a fuel injection pump embodying the features of the present invention taken along the axis of a pump element.
Figure 2:
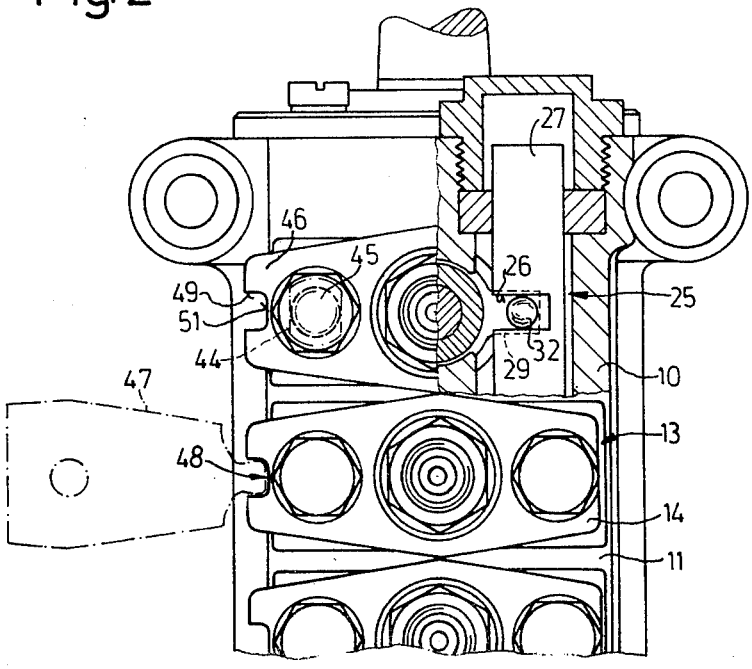
FIG. 2 is a cross-sectional view taken along the line II—II in FIG. 1.

Turning now to FIG. 1, a fuel injection pump embodied as a multi-cylinder serial pump is shown. The discussion that follows will be confined to a single cylinder. The pump has a pump housing 10 within which a bore 12 is formed. The bore 12 extends from an upper face 11 of the housing 10 and into the housing 10 perpendicular to a camshaft of the pump (not shown). Inserted within the bore 12 is a flanged element 13 which consists substantially of a cylinder bushing 15 provided with a mounting flange 14. In the embodiment shown in FIG. 1, the mounting flange 14 rests on a cylindrical extension 18 at the extreme end of the cylinder bushing 15 and is permanently attached thereto by hard soldering in a pass-through furnace or by inductive hard soldering. The cylinder bushing 15 defines a bore 16 within which a pump piston 17 is guided. At one end of the pump piston 17 there is provided drive means (not shown) for driving the pump piston 17.

The bore 16 of the cylinder bushing 15 which guides the pump piston 17 includes a pump working chamber 21, adjacent to the end of the piston 17 remote from the drive means. The chamber 21 is limited at one end by a face 19 of the pump piston 17. This pump working chamber 21 is provided with fuel through a control bore 22 in the wall of the bushing 15 during a suction stroke executed by the piston 17. The bore 22 communicates with a suction chamber 23 which surrounds the cylinder bushing 15 and is located in the pump housing 10. Fuel is delivered through the bore 22 from the chamber 23. If there is only a single bore, the control bore 22 also serves as the return bore for the fuel which flows out of the pump working chamber 21 back into the suction chamber 23 at the end of an effective pressure stroke of the piston 17. The return is controlled by the cooperation of an oblique control edge 24 on the pump piston 17 with the control bore 22. The amount of fuel flowing back and hence also the delivered fuel quantity is dependent on the relative position of the oblique control edge 24 with respect to the control bore 22. This position is determined by the angular position of the pump piston 17 which may be rotated by a known adjustment mechanism 25 for the purpose of changing the delivered fuel quantity.

The adjustment mechanism 25 consists of a longitudinally movable fuel rack 27 having recesses 26 and a control sleeve 28. At one end of the control sleeve 28 there is provided an actuator arm 29 and ball 33 soldered thereto which engages the recess 26 in the fuel rack 27. The other end of the control sleeve 28 is coupled with a protrusion 33 of the pump piston 17 in such a way that the pump piston 17 follows the rotational motions of the control sleeve 28 caused by the fuel rack 27 without thereby affecting its axial mobility.

A pressure control valve 35 is located within the bore 16 adjacent to the pump working chamber 21 opposite to the face 19. The control valve 35 has a valve housing 36 which is inserted into an enlarged region 37 of the bore 16. The valve housing 36 is held in its installed position in the cylinder bushing 15 by a threaded nipple 38 which provides a high-pressure seal. The threaded nipple 38 has a spring chamber 39 in which a valve spring 42 is located for loading a movable valve member 41. A pressure line 43, shown only in part, is connected to the threaded nipple 38 for carrying the fuel in a known manner to an injection nozzle (not shown).

The mounting flange 14 of the cylinder bushing 15 is provided with elongated holes 44 and is clamped with two bolts 45 to the upper face 11 of the pump housing 10. Since it is desired to have a relatively small distance between the individual pump elements when a multi-cylinder pump is involved, the mounting flange 14 has a known, approximately oval, shaped but, in contrast to the known flanged elements, a portion 46 of the mounting flange 14 is extended beyond the length required for holding the mounting bolts 45 and this is done so that the outermost rim of the mounting flange 14 can be provided with a slot 48 whose sides 49 and base 51 are parallel to the longitudinal axis of the cylinder bushing 15 and which is intended as the region of engagement of an adjustment tool 47 shown by the dash-dot lines. The slot 48 is machined into the portion 46 of the mounting flange 14 and has a distance *a* from the central axis of the cylinder bushing 15 which is greater than the outer radial limit of the bolts 45.

The cylinder bushing 15 equipped with the mounting flange 14 can be rotated for the purpose of making the basic setting of the delivered fuel quantity after at least a partial release of the bolts 45. In this basic setting of the fuel quantity, the relative position of the control bore 22 with respect to the oblique control edge 24 on the pump piston 17 is so adjusted that, at a predetermined position of the fuel rack 27, an also previously determined fuel injection quantity is supplied. When multi-cylinder injection pumps are involved, all the cylinders of one pump are set to the same fuel supply quantity, i.e., they are set to the same position.

With the flange element 13 of the fuel injection pump according to the invention, this setting may be made by an adjustment tool 47 which engages the slot 48. The portion 46 of the mounting flange 14 which includes the slot 48 extends beyond the upper face 11 of the pump housing 10 and this permits the adjustment tool 47 to be made substantially stronger with a view to longer life and the high adjustment forces that are to be transmitted, without thereby adversely affecting the structural height of the mounting flange. Since the adjustment tool 47 may be driven mechanically, for example, by an electric motor, and since the form of the slot 48 in the mounting flange 14 permits the transmission of relatively high forces, the embodiment of the mounting flange 14 according to the invention permits a rotation of the cylinder bushing 15 within the angular region limited by the elongated holes 44 for the purpose of setting the basic fuel quantity while the pump is running. For this purpose, the bolts 45 are released only so much that the flanged element 13 cannot change its axial position under pumping stresses and that, after the adjustment has taken place and the bolts 45 are tightened, no further change of position takes place.

While the slot 48 has been proven to be the most favorable and cheapest possibility for engaging the adjustment tool 47, it is possible, for example, to provide the part 46 of mounting flange 14 with teeth (not shown) serving at the point of engagement for an adjustment tool 47 which, in that case, would have a toothed segment.

A precondition for making possible the adjustment of a basic fuel setting when the pump is running is also the presence of the pressure valve, installed within the flange element 13 with a high pressure seal. This is accomplished by the pressure valve 35. Injection pumps of different construction are known, however, in which a rotation of the cylinder bushing is also made possible, for example, by means of a groove or a worm-like gearing in the circumference thereof. However, in the elements of these pumps, the pressure valve is held compressed between the cylinder bushing and the threaded nipple and, after the threaded nipple has been released, which is necessary for setting the rotational position of the cylinder bushing, it is no longer pressure-tight. In addition to this disadvantage, which does not permit a basic setting of the fuel quantity when the pump is running, other disadvantages which can be named at the very short lever arm available for the adjustment tool which is limited by the outer diameter of the cylinder bushing and also the danger that the set position may be changed by tightening the threaded nipple.

In the exemplary embodiment shown in the drawing, the mounting flange 14 is shown as a part rigidly connected with the cylinder bushing 15. However, without diminishing the possible advantages, the invention may also be used in injection pumps in which the mounting flanges are part of a flanged sleeve (not shown) which includes the cylinder bushing, the pressure valve and the threaded nipple.

What is claimed is:

1. In combination, a fuel injection pump for use in internal combustion engines, and an adjustment tool for adjusting the basic fuel quantity setting for the pump, the pump including:

a. a housing within which there is formed at least one bore for receiving a piston and an associated guiding structure, and an associated pair of bolt receiving bores, with all the bores extending into the body of the housing from an upper end face thereof;

b. a cylinder bushing mounted within the receiving bore of the housing and forming the guiding structure for the piston, the cylinder bushing forming an axial bore into which the piston extends and within which the piston is displaced, and at least one control bore in the side wall thereof; said cylinder bushing being received within the receiving bore of the housing so that it can be rotated within a limited angular region for effecting a basic setting of fuel quantity supplied by the pump;

c. a pair of bolts;

d. a mounting flange fastened to the cylinder housing and extending transversely outwardly therefrom, said mounting flange including a pair of bores which align with the bolt receiving bores when the mounting flange is mounted to the upper end face of the housing by the pair of bolts, said mounting flange including an adjustment tool engaging portion at the outer circumference thereof, said engaging portion being formed as a slot within the mounting flange located at a greater transverse distance from the longitudinal axis of the cylinder bushing than the maximum transverse distance of the bolts from said longitudinal axis, said slot having side walls and a base which are parallel to the longitudinal axis of the cylinder bushing, the adjustment tool being adapted to engage the engaging portion to effect the rotation of the cylinder bushing within the limited angular region;

e. a piston mounted within the axial bore of said cylinder bushing, said piston having an oblique control edge formed on its outer surface, said control edge cooperating with the at least one control bore for controlling the quantity of fuel delivered by the pump; and f. a pressure valve mounted within said axial bore, said pressure valve serving to control the outflow of fuel from the pump under the injection pressure.

2. In combination, a fuel injection pump for use in internal combustion engines, and an adjustment tool for adjusting the basic fuel quantity setting for the pump, the pump including:

a. a housing within which there is formed at least one bore for receiving a piston and an associated guiding structure, and an associated pair of bolt receiving bores, with all the bores extending into the body of the housing from an upper end face thereof;

b. a cylinder bushing mounted within the receiving bore of the housing and forming the guiding structure for the piston, the cylinder bushing forming an axial bore into which the piston extends and within which the piston is displaced, and at least one control bore in the side wall thereof; said cylinder bushing being received within the receiving bore of the housing so that it can be rotated within a limited angular region for effecting a basic setting of the fuel quantity supplied by the pump;

c. a pair of bolts;

d. a mounting flange fastened to the cylinder bushing and extending transversely outwardly therefrom, said mounting flange including a pair of bores which align with the bolt receiving bores when the mounting flange is mounted to the upper end face of the housing by the pair of bolts, said mounting flange including an adjustment tool engaging portion at the outer circumference thereof, said engaging portion being located at a greater transverse distance from the longitudinal axis of the cylinder bushing than the maximum transverse distance of the bolts from said longitudinal axis;

e. a piston mounted within the axial bore of said cylinder bushing, said piston having an oblique control edge formed on its outer surface, said control edge cooperating with the at least one control bore for controlling the quantity of fuel delivered by the pump; and f. a pressure valve mounted within said axial bore, said pressure valve serving to control the outflow of fuel from the pump under an injection pressure; the adjustment tool having an extension adapted to engage the engaging portion of the mounting flange to impart a force to the mounting flange independently of the bolts to effect the rotation of the cylinder bushing within the limited angular region.

3. The combination as defined in claim 1, wherein the tool engaging portion extends transversely beyond the upper face of the pump housing.

4. The combination as defined in claim 1, wherein said pressure valve includes a housing, a movable member, a nipple which is threadedly engaged within said axial bore and a spring, said spring being mounted within said nipple and in engagement with the movable member.

* * * * *